US005387323A

United States Patent [19]

Minday et al.

[11] Patent Number: 5,387,323

[45] Date of Patent: Feb. 7, 1995

[54] PROCESS FOR PREPARING FLUOROCHEMICALS

[75] Inventors: Richard M. Minday, Stillwater, Minn.; Thomas M. Barrett, Prescott; Charles F. Kolpin, River Falls, both of Wis.; John C. Smeltzer, Woodbury, Minn.

[73] Assignee: Minnesota Mining and Manufacturing Company, St. Paul, Minn.

[21] Appl. No.: 115,202

[22] Filed: Aug. 31, 1993

[51] Int. Cl.[6] ..... C25B 3/08

[52] U.S. Cl. ..... 204/59 F

[58] Field of Search ..... 204/59 F; C25B 3/08

[56] References Cited

U.S. PATENT DOCUMENTS

| | | | |
|---|---|---|---|
| 2,519,983 | 8/1950 | Simons | 204/62 |
| 2,567,011 | 9/1951 | Diesslin et al. | 260/465.7 |
| 2,666,797 | 1/1954 | Husted et al. | 260/633 |
| 2,691,043 | 10/1954 | Husted et al. | 260/583 |
| 2,713,593 | 7/1955 | Brice et al. | 260/535 |
| 2,732,398 | 1/1956 | Brice et al. | 260/503 |
| 3,616,315 | 10/1971 | Childs | 204/60 |
| 3,650,917 | 3/1972 | Ruehlen | 204/59 |
| 3,840,445 | 10/1974 | Paul et al. | 204/59 F |
| 3,950,235 | 4/1976 | Benninger | 204/59 F |
| 3,957,596 | 5/1976 | Seto | 204/59 F |
| 3,980,534 | 9/1976 | Drakesmith | 204/59 F |
| 4,146,443 | 3/1979 | Childs | 204/62 |
| 4,158,023 | 6/1979 | von Halasz | 260/653.9 |
| 4,377,715 | 3/1983 | Nychka et al. | 570/123 |

FOREIGN PATENT DOCUMENTS 4-12243 5/1985 Japan .

OTHER PUBLICATIONS

Childs, W. V., L. Christensen, F. W. Klink, and C. F. Kolpin, *Organic Electrochemistry* (H. Lund and M. M. Baizer, editors), Third Edition, pp. 1103–1112, Marcel Dekker, Inc., New York (1991).

Rudge, A. J., *Industrial Electrochemical Processes* (A. T. Kuhn, editor), pp. 71–75, Marcel Dekker, Inc., New York (1967).

Saffarian, H., P. Ross, F. Behr, and G. Gard, J. Electrochem. Soc. 139, 2391 (1992).

*Fluorine Chemistry*, edited by J. H. Simmons, pp. 416–418, Academic Press, Inc., New York (1950).

Nagase, S. et al., Bull. Chem. Soc. Japan 39 (2), 219–222 (1966).

Nagase, S. et al., Bull. Chem. Soc. Japan 40 (3), 684–686 (1967).

*Primary Examiner*—Kathryn Gorgos

*Attorney, Agent, or Firm*—Gary L. Griswold; Walter N. Kirn; Lucy C. Weiss

[57] ABSTRACT

A process for preparing fluorochemical compounds, e.g., perfluoroalkanes, perfluoroethers, and perfluoroalkyl tertiary amines, comprises (a) forming a mixture comprising at least one fluorinatable, non-functional organic starting compound, e.g., propane, and at least one other compound which is present in an amount sufficient to enable the formation of a fluorochemical phase and which is selected from the group consisting of (i) perfluorochemical compounds, e.g., perfluorohexane, which boil at a higher temperature than either the fluorinatable, non-functional organic starting compound or the fluorochemical compound resulting from the subsequent fluorination of the fluorinatable, non-functional organic starting compound; and (ii) precursor compounds, e.g., hexane, which can be fluorinated in situ to produce such perfluorochemical compounds; and (b) subjecting the mixture to electrochemical fluorination in the presence of anhydrous hydrogen fluoride.

16 Claims, No Drawings

PROCESS FOR PREPARING FLUOROCHEMICALS

This invention relates to a process for preparing fluorochemicals by the electrochemical fluorination of fluorinatable organic starting compounds.

Fluorochemical compounds and their derivatives (sometimes called organofluorine compounds or fluorochemicals) are a class of substances which contain portions that are fluoroaliphatic or fluorocarbon in nature, e.g., nonpolar, hydrophobic, oleophobic, and chemically inert, and which may further contain portions which are functional in nature, e.g., polar and chemically reactive. The class includes some commercial substances which are familiar to the general public, such as those which give oil and water repellency and stain and soil resistance to textiles. The class also includes perfluorocarbons and hydrofluorocarbons, which are useful as replacements for the chlorofluorocarbon compounds (CFCs) that have been linked to the destruction of the earth's protective ozone layer.

An industrial process for producing many fluorochemical compounds, such as perfluorinated and partially-fluorinated organofluorine compounds, is the electrochemical fluorination process commercialized initially in the 1950s by 3M Company, which comprises passing an electric current through an electrolyte, viz., a mixture of fluorinatable organic starting compound and liquid anhydrous hydrogen fluoride, to produce the desired fluorinated compound or fluorochemical. This fluorination process, commonly referred to as the "Simons electrochemical fluorination process" or, more simply, either the Simons process or Simons ECF, is a highly energetic process which is somewhat hazardous due to the use of anhydrous hydrogen fluoride.

Some early patents describing the Simons process and its use to prepare such subclasses of fluorochemicals as fluorocarbon carbonyl fluorides, fluorocarbon sulfonyl fluorides, and derivatives thereof include U.S. Pat. Nos. 2,519,983 (Simons), 2,567,011 (Diesslin et al.), 2,666,797 (Husted et al.) 2,691,043 (Husted et al.), and 2,732,398 (Brice et al.) The Simons process is also disclosed in some detail by J. Burdon and J. C. Tatlow in *Advances in Fluorine Chemistry* (M. Stacey, J. C. Tatlow, and A. G. Sharpe, editors), Volume 1, pages 129–37, Butterworths Scientific Publications, London (1960), by W. V. Childs, L. Christensen, F. W. Klink, and C. F. Kolpin in *Organic Electrochemistry* (H. Lund and M. M. Baizer, editors), Third Edition, pages 1103–12, Marcel Dekker, Inc., New York (1991), and by A. J. Rudge in *Industrial Electrochemical Processes* (A. T. Kuhn, editor), pages 71–75, Marcel Dekker, Inc., New York (1967).

Although functional compounds such as hydrocarbon carbonyl fluorides and hydrocarbon sulfonyl fluorides are soluble in anhydrous hydrogen fluoride and can thus be relatively easily fluorinated by the Simons process, some fluorinatable organic starting compounds, e.g., hydrocarbons and halohydrocarbons, are somewhat difficult to fluorinate due to their low solubility. For such compounds, additives have been used to enhance conductivity. Useful inert additives include the alkali metal and alkaline earth metal fluorides, although these additives contribute to higher anode corrosion rates and cause the conductivity of the electrolyte to remain high even after the organic starting compound is consumed. Since the high conductivity masks the end of the fluorination, fluorine evolution and explosion hazards are particularly difficult to avoid. Fluorinatable additives such as alcohols, carboxylic acids, and sulfur compounds can also be used, but these produce by-products during the fluorination and reduce the current efficiency of the process. (See, e.g., Childs et al., supra, at page 1106.)

U.S. Pat. No. 3,950,235 (Benninger) notes the difficulty of preparing perfluoroalkanes by the Simons electrochemical fluorination of aliphatic hydrocarbons (due to the "insolubility" of the hydrocarbons in hydrogen fluoride) or by the Simons electrochemical fluorination of olefinic hydrocarbons (because of the quick anode blocking resulting from the formation of polymer products on the anode surface) and describes an alternative process wherein branched perfluoroolefins are electrochemically fluorinated to produce the corresponding branched perfluoroalkanes.

Japanese Pat. Application No. JP 4-12243 (Daikin Kogyo KK.) describes a process for preparing octafluoropropane by electrochemically fluorinating hexafluoropropene using an alkyl amine as a conductivity additive. This additive is said to function without seriously corroding the anode, and, if propyl amine or dipropyl amine is chosen, is said to be converted to additional octafluoropropane during the fluorination process.

U.S. Pat. No. 3,957,596 (Seto) discloses an improved process for the electrochemical fluorination of hydrocarbons, wherein the electrochemical fluorination cell is maintained at superatmospheric pressure, conductivity additives are omitted, and the electrode gap, turbulence, and electrical energy input are controlled to provide improved yield and current efficiency.

Inert fluorocarbon diluents, e.g., $C_8F_{18}$, have been utilized in the preparation of functional compounds, namely, $\alpha,\omega$-difluorosulfonyl perfluoroalkanes, by Simons electrochemical fluorination of the hydrocarbon $\alpha,\omega$-difluorosulfonyl alkanes in anhydrous hydrogen fluoride. (See H. Saffarian, P. Ross, F. Behr, and G. Gard, J. Electrochem. Soc. 139, 2391 (1992).)

Briefly, this invention provides a process for preparing fluorochemical compounds, e.g., perfluorinated or partially-fluorinated alkanes, ethers, alkyl tertiary amines, and amino ethers, which comprises (a) forming a mixture comprising at least one fluorinatable, non-functional organic starting compound, e.g., propane, and at least one other compound which is present in an amount sufficient to enable the formation of a fluorochemical phase and which is selected from the group consisting of
  (i) perfluorochemical compounds, e.g., perfluorohexane, which boil at a higher temperature than either the fluorinatable, non-functional organic starting compound or the fluorochemical compound resulting from the subsequent fluorination of the fluorinatable, non-functional organic starting compound; and
  (ii) precursor compounds, e.g., hexane, which can be fluorinated in situ to produce such perfluorochemical compounds; and
(b) subjecting the mixture to electrochemical fluorination in the presence of anhydrous hydrogen fluoride.

As used herein, the term "non-functional" means that the compound does not contain a carboxylic acid, carboxylic acid ester, carboxylic acid halide, sulfonic acid, sulfonic acid halide, or sulfonic acid ester functional group. Preferably, perfluorochemical compounds rather than precursor compounds are utilized in the process of the invention, as it is more convenient and efficient to add the perfluorochemical initially than to generate it by in situ fluorination of the precursor. This also avoids the increased production of vent gases, e.g., hydrogen, which would accompany the precursor fluorination and would cause increased product loss. The perfluorochemical compound(s), whether added or generated in situ, preferably boil at temperature(s) at least about 20° C. higher, more preferably about 50° C. higher, than the fluorinatable organic starting compound or the fluorochemical compound resulting from the subsequent fluorination of the fluorinatable, non-functional organic starting compound.

The process of the invention is preferably used for fluorinating non-functional organic starting compounds which are not very soluble in anhydrous hydrogen fluoride (e.g., aliphatic or cyclic hydrocarbons and halohydrocarbons having solubilities less than about 10 weight percent at room temperature), as the perfluorochemical component of the mixture can act in such cases as a solvent or reservoir for the starting compound (as well as for the fluorochemical product) and also can reduce or eliminate the need for conductivity additive. In addition, the presence of the perfluorochemical component provides more stable cell operation, reduces anode fouling, and also enables the fluorination to be carried out at a lower pressure for a given temperature. Thus, the process can be advantageously used to fluorinate relatively volatile non-functional organic starting compounds, e.g., those which have boiling points below room temperature at atmospheric pressure, as such compounds must be fluorinated at higher pressures (for a given temperature) than those at which less volatile compounds can be fluorinated. The process is most preferably used for fluorinating non-functional organic starting compounds which are both relatively volatile and difficult to dissolve in anhydrous hydrogen fluoride, e.g., aliphatic or cyclic hydrocarbons and halohydrocarbons which have boiling points below room temperature at atmospheric pressure. The ability to carry out the fluorination at lower pressure reduces the need for expensive equipment which is capable of very high pressure operation, reduces the likelihood of leakage of the corrosive anhydrous hydrogen fluoride, and reduces the likelihood of explosion.

Although the process of the invention is preferably used to fluorinate organic starting compounds which are somewhat difficult to fluorinate by the traditional Simons process, the process can be used to fluorinate any organic starting compound which is fluorinatable, i.e., which contains carbon-bonded hydrogen atoms which are replaceable by fluorine and/or contains carbon-carbon unsaturation which is saturateable with fluorine. Thus, suitable organic starting compounds include ethers; amines; amino ethers; aliphatic hydrocarbons, halocarbons, and halohydrocarbons; cyclic hydrocarbons, halocarbons, and halohydrocarbons; divalent sulfur compounds; and mixtures thereof. Such compounds can be unfluorinated or partially-fluorinated and can contain small amounts of carbon-bonded chlorine. Representative examples of such compounds include dimethyl ether, diethyl ether, dipropyl ether, dibutyl ether, methylethyl ether, methylpropyl ether, methylbutyl ether, trimethyl amine, triethyl amine, tripropyl amine, tributyl amine, methyldiethyl amine, ethyldipropyl amine, methyl morpholine, ethyl morpholine, propyl morpholine, isopropyl morpholine, methane, ethane, propane, butane, pentane, hexane, heptane, octane, propene, butene, pentene, hexene, propyne, cyclopropane, cyclobutane, cyclopentane, cyclohexane, methylcyclobutane, methylcyclopentane, hexafluoropropene, fluoroethane, tetrafluoroethylene, vinylidene fluoride, fluoropropane, tetrafluorocyclobutane, methyl thiol, ethyl thiol, propyl thiol, dimethyl sulfide, diethyl sulfide, dipropyl sulfide, and mixtures thereof. The process is preferably utilized to fluorinate aliphatic hydrocarbons, aliphatic halohydrocarbons, cyclic hydrocarbons, cyclic halohydrocarbons, and mixtures thereof, most preferably those which boil below room temperature at atmospheric pressure.

The perfluorochemical component of the mixture which is formed according to the process of the invention can be any perfluorochemical compound which boils at a higher temperature than the fluorinatable, non-functional organic starting compound (or the fluorochemical compound resulting from its fluorination) or can be any precursor compound (other than the fluorinatable, non-functional organic starting compound) which can be fluorinated in situ (i.e., in the subsequent electrochemical fluorination step) to produce such a perfluorochemical compound. Mixtures of such perfluorochemical compounds, such precursor compounds, or both can also be utilized. Such mixtures can contain perfluorochemical compounds (or precursor compounds) which boil at a lower temperature than the fluorinatable, non-functional organic starting compound (or the fluorochemical compound resulting from its fluorination) provided that the overall mixture of perfluorochemical compounds boils at a higher temperature than the fluorinatable, non-functional organic starting compound (or the fluorochemical compound resulting from its fluorination). The perfluorochemicals utilized are preferably capable of dissolving the fluorinatable, non-functional organic starting compound (where such starting compound is not very soluble in anhydrous hydrogen fluoride) and are also preferably stable under electrochemical fluorination conditions.

Perfluorochemical compounds suitable for use in the process of the invention include perfluoroalkanes, pentafluorosulfanyl-substituted perfluoroalkanes, perfluorocycloalkanes, perfluoroamines, perfluoroethers, perfluoropolyethers, perfluoroaminoethers, perfluoroalkanesulfonyl fluorides, perfluorocarboxylic acid fluorides, and mixtures thereof. Such compounds can contain some hydrogen or chlorine, e.g., less than one atom of either hydrogen or chlorine for every two carbon atoms, but are preferably substantially completely fluorinated. Representative examples of such compounds include perfluorobutane, perfluoroisobutane, perfluoropentane, perfluoroisopentane, perfluorohexane, perfluoromethylpentane, perfluoroheptane, perfluoromethylhexane, perfluorodimethylpentane, perfluorooctane, perfluoroisooctane, perfluorononane, perfluorodecane, 1-pentafluorosulfanylperfluorobutane, 1-pentafluorosulfanylperfluoropentane, 1pentafluorosulfanylperfluorohexane, perfluorocyclobutane, perfluoro(1,2dimethylcyclobutane), perfluorocyclopentane, perfluorocyclohexane, perfluorotrimethylamine, perfluorotriethylamine, perfluorotripropylamine, perfluoromethyldiethylamine, perfluorotributylamine, perfluorotriamylamine, perfluoropropyltetrahydrofuran, perfluorobutyltetrahydrofuran, perfluoropoly(tetramethylene oxide), perfluoro(N-methylmorpholine), perfluoro(N-ethylmorpholine), perfluoro(N-propylmorpholine), perfluoropropanesulfonyl fluoride, perfluorobutanesulfonyl fluoride, perfluoropentanesulfonyl fluoride, perfluorohexanesulfonyl fluoride, perfluoroheptanesulfonyl fluoride, perfluorooctanesulfonyl fluoride, perfluorohexanoyl fluoride, perfluorooctanoyl fluoride, perfluorodecanoyl fluoride, and mixtures thereof. Due to considerations of cost, availability, and stability, perfluoroalkanes are preferred perfluorochemical compounds for use in the process of the invention. Suitable precursor compounds (which can be fluorinated in situ to produce perfluorochemical compounds) include the unfluorinated, partially-fluorinated, and/or unsaturated counterparts of the above-described perfluorochemical compounds, as well as compounds which can cleave and fluorinate under electrochemical fluorination conditions to produce suitable perfluorochemical compounds.

The process of the invention can be carried out by introducing, e.g., by pumping, at least one fluorinatable, non-functional organic starting compound and at least one perfluorochemical compound (or precursor compound) to a Simons electrochemical fluorination cell containing anhydrous hydrogen fluoride (or to which anhydrous hydrogen fluoride is simultaneously or subsequently added). The fluorinatable, non-functional organic starting compound(s), the perfluorochemical compound(s) (or precursor compound(s)), and the anhydrous hydrogen fluoride can be introduced as three separate streams or can be combined (in any manner) and introduced as fewer than three streams. The resulting mixture of compounds in anhydrous hydrogen fluoride is then electrochemically fluorinated by the Simons process, preferably with agitation.

The Simons electrochemical fluorination cell is an electrolytic cell in which is suspended an electrode pack comprising a series of alternating and closely-spaced cathode plates (typically made of iron or nickel or nickel alloy) and anode plates (typically made of nickel). The cell body, made of carbon steel, usually is provided with a cooling jacket, a valved outlet pipe at the bottom through which can be drained the settled liquid cell product ("drainings"), a valved inlet pipe at the top of the cell for charging the cell with liquid anhydrous hydrogen fluoride, the fluorinatable organic starting compound(s), and the perfluorochemical compound(s) (or precursor compound(s)), and an outlet pipe at the top of the cell for removing gaseous cell products evolved in operation of the cell. The outlet pipe can be connected to a refrigerated condenser for condensing vapor comprising hydrogen fluoride, organic starting compound, and fluorochemicals, which can be drained back into the cell. Said U.S. Pat. No. 2,519,983 contains a drawing of such a Simons electrolytic cell and its appurtenances, and a description and photographs of laboratory and pilot plant cells appear at pages 416–18 of the book *Fluorine Chemistry*, edited by J. H. Simons, published in 1950 by Academic Press, Inc., New York.

The Simons cell can be operated at average applied direct current cell voltages in the range of from about 4 to about 8 volts (sufficiently high, but not so high as to generate free fluorine), at current densities of from about 4 to about 20 mA/cm$^2$ (or higher) of anode surface, at substantially atmospheric or ambient pressure or higher, and at temperatures ranging from below about 0° C. to about 20° C. or as high as about 50° C. (so long as the electrolytic solution remains essentially liquid).

The initial amount of fluorinatable, non-functional organic starting compound introduced to the Simons cell can be, for example, up to about 20 weight percent of the total cell contents (i.e., of the mixture of starting compound, perfluorochemical or precursor compound, and anhydrous hydrogen fluoride), and the starting compound, the anhydrous hydrogen fluoride, and the perfluorochemical or precursor can be replenished from time to time. Perfluorochemical compound or precursor compound (or a mixture of either or both) is utilized in an amount sufficient to provide a liquid fluorochemical phase, i.e., in an amount which exceeds the solubility of the perfluorochemical (or mixture of perfluorochemicals, some of which can be low-boiling as described supra) in anhydrous hydrogen fluoride at the process temperature. Thus, the amount of perfluorochemical or precursor needed in a particular case will depend upon the solubility of the perfluorochemical in anhydrous hydrogen fluoride at the process temperature and upon the amount of anhydrous hydrogen fluoride used. If precursor compound (rather than perfluorochemical compound) is utilized, the cell is preferably operated for a period of time sufficient to fluorinate enough precursor to provide a liquid fluorochemical phase prior to the addition of fluorinatable, organic starting compound. This preliminary operation is most important where the starting compound is not very soluble in anhydrous hydrogen fluoride. To avoid "current blocking" (permanent loss of conductivity) while carrying out the process of the invention, the fluorochemical phase preferably will contain an amount of fluorinatable, non-functional organic starting compound sufficient to maintain the desired current density (e.g., at least about 6 mole percent propane at 38.6 mA/cm$^2$ and 30° C.). Although conductivity additives are generally not necessary, they can be utilized in the process if desired.

Other details of the Simons electrochemical fluorination process and cell will be omitted here in the interest of brevity, and the disclosures of such technology in the above-cited references to such technology can be referred to for such detail, which disclosures are incorporated herein by reference.

The process of the invention can be carried out continuously (by continuously introducing fluorinatable, non-functional organic starting compound, perfluorochemical compound (or precursor compound), and/or anhydrous hydrogen fluoride to the cell and continuously withdrawing liquid cell product), semi-continuously (by continuously introducing starting compound, perfluorochemical (or precursor), and/or anhydrous hydrogen fluoride and intermittently withdrawing product, or by intermittently introducing starting compound, perfluorochemical (or precursor), and/or anhydrous hydrogen fluoride and continuously withdrawing product), or batchwise. The continuous mode is preferred for large-scale use of the process, as it enables better control of the operating variables and thus provides more stable cell operation. Generally, the desired fluorochemical product of the process of the invention is preferably recovered from the crude cell product resulting from the fluorination, e.g., by condensation, phase-separation, and draining, followed by distillation. When relatively volatile, fluorinatable, non-functional organic starting compounds are utilized, the desired fluorochemical product is preferably removed from the cell continuously at the rate at which it is being produced, in order to maintain a constant composition in the cell and to thereby maintain maximum cell temperature and current. The fluorochemical product can optionally be treated with caustic to remove hydride-containing fluorochemicals.

Any fluorinatable, non-functional organic starting compound can be fluorinated by the process of the invention, but the process is most useful for fluorinating volatile, non-functional organic starting compounds which are not very soluble in anhydrous hydrogen fluoride, e.g., low molecular weight, aliphatic or cyclic hydrocarbons and halohydrocarbons. The process enables the fluorination of such compounds at lower pressures than those typically required, and with little or no need for conductivity additives. The ability to carry out the fluorination at lower pressure reduces the need for expensive equipment capable of very high pressure operation, reduces the likelihood of leakage of the corrosive anhydrous hydrogen fluoride, and reduces the likelihood of explosion.

This invention is further illustrated by the following examples, but the particular materials and amounts thereof recited in these examples, as well as other conditions and details, should not be construed to unduly limit this invention.

EXAMPLES

Example 1

Preparation of Perfluoropropane by Electrochemical Fluorination of Propane in the Presence of Added Higher Boiling Perfluorochemical Compounds A 2.5 liter Simons electrochemical fluorination cell of the type described in U.S. Pat. No. 2,713,593, equipped with three overhead condensers having brine temperatures of 22° C., −40° C., and −80° C. respectively, was charged with 2 kg of anhydrous hydrogen fluoride, 15 g of dimethyl disulfide, and 770 g of a mixture of perfluorochemicals comprising primarily perfluoropentane ($C_5F_{12}$) and perfluorohexane ($C_6F_{14}$) and having a boiling range of 50°-60° C. The added perfluorochemicals formed a separate fluorochemical phase which accumulated at the bottom of the cell. Initially, the dimethyl disulfide was fluorinated to confirm the conductivity of the cell. Propane ($C_3H_8$) was then continuously fed to the cell at an average rate of 8.4 g/50Ahr along with a cofeed of the same composition as the above-described mixture of perfluorochemicals at an average rate of 18 g/50Ahr. Anhydrous hydrogen fluoride was added to the cell intermittently as needed throughout the run, and a cell pressure of 65 psig (3360 torr gauge) and current densities ranging from 18 A/ft$^2$ to 40 A/ft$^2$ (19.3 to 42 mA/cm$^2$) were maintained. The temperature of the cell was initially 44° C. and dropped to 6° C. during the first 24 hours of the run. After running the cell for 70 hours, the $C_6F_{14}/C_5F_{12}$ feed rate was increased to an average of 48 g/50Ahr, and the cell temperature rose to 21° C. to 25° C. as the cell reached steady state operation. Beginning at 51 hours into cell operation, the fluorochemical phase was partially drained from the cell in a semi-continuous fashion, at an average rate of 52 g/50Ahr, while always maintaining the presence of a fluorochemical phase in the cell. The average composition of the fluorochemical phase (as determined by gas chromatography and infrared analysis (GC/IR)) was 25.5 weight percent $C_3F_8$, 3.7 weight percent $C_3H_8$s, 65.5 weight percent $C_5F_{12}$ and $C_6F_{14}$, and 5.3 weight percent propane hydrides and other fluorochemicals.

Example 2

Preparation of Perfluorobutane by the Electrochemical Fluorination of Butane in the Presence of Added Perfluorohexane Phase I A 2.5 liter Simons electrochemical fluorination cell of the type described in U.S. Pat. No. 2,713,593, equipped with three overhead condensers having brine temperatures of 22° C., −40° C., and −80° C. respectively, was charged with 2.0 kg of anhydrous hydrogen fluoride and 10 g of dimethyl disulfide. Initially, the dimethyl disulfide was fluorinated to confirm the conductivity of the cell. Butane ($C_4H_{10}$) was then continuously fed to the cell at an average rate of 8.8 g/50Ahr. Anhydrous hydrogen fluoride was added to the cell intermittently as needed throughout the run. A cell pressure of 55 psig (2843 torr gauge) was maintained. The temperature of the cell was initially 33.4° C. and dropped to 28.0° C when the cell reached steady-state operation. The cell was maintained at voltages ranging from 5.1 V to 6.1 V and current densities ranging from 12.5 A/ft$^2$ to 45.9 A/ft$^2$ (13.5 to 49.4 mA/cm$^2$). A fluorochemical phase formed and accumulated in the bottom of the cell. This fluorochemical phase was partially drained from the cell in a semi-continuous fashion (while always maintaining the presence of a fluorochemical phase in the cell) at an average collection rate of 12.9 g/50Ahr. The average composition of the collected fluorochemical phase was 5.0 weight percent $C_4H_{10}$, 78.3 weight percent $C_4F_{10}$, 2.4 weight percent $C_6F_{14}$, 5.2 weight percent $C_8F_{18}$, and 9.1 weight percent partially-fluorinated butane and other fluorochemicals, as determined by gas chromatography and infrared analysis (GC/IR).

Phase II

After running the experiment for 10170 Ahrs, a perfluorohexane ($C_6F_{14}$) cofeed to the cell was started at an average rate of 11.1 g/50Ahr. The cell temperature rose to 33.9° C., and the cell was maintained at a current density of 43.1 A/ft$^2$( 46.4 mA/cm$^2$) and a voltage of 5.2 V. The fluorochemical phase was partially drained from the cell in a semi-continuous manner at a rate of 39.7 g/50Ahr (while always maintaining the presence of a fluorochemical phase in the cell). After an additional 2120 Ahrs, the composition of the fluorochemical phase in the cell was 3.1 weight percent $C_4H_{10}$, 57.1 weight percent $C_4F_{10}$, 28.0 weight percent $C_6F_{14}$, 0.9 weight percent $C_8F_{18}$, and 10.9 weight percent partially-fluorinated butane and other fluorochemicals, as determined by GC/IR anaylsis of the drained portion of the fluorochemical phase. Phase III After a total of 12290 Ahrs, the rate of the perfluorohexane ($C_6F_{14}$) cofeed to the cell was increased to 41.8 g/50Ahr, and the run was continued for an additional 2320 Ahrs. The cell temperature rose to 44.6° C., and the cell was maintained at a current density of 46.2 A/ft$^2$ and a voltage of 5.6 V. The fluorochemical phase was partially drained from the cell in a semi-continuous manner at a rate of 54.4 g/50Ahr (while always maintaining the presence of a fluorochemical phase in the cell). The composition of the fluorochemical phase in the cell after the additional 2320 Ahrs was 2.5 weight percent $C_4H_{10}$, 42.3 weight percent $C_4F_{10}$, 45.8 weight percent $C_6F_{14}$, 0.4 weight percent $C_8F_{18}$, and 9.0 weight percent partially-fluorinated butane and other fluorochemicals, as determined by GC/IR analysis of the drained portion of the fluorochemical phase.

Example 3

Preparation of Perfluoropropane by the Electrochemical Fluorination of Hexafluoropropene in the Presence of Added Higher Boiling Perfluorochemical Compounds A 2.5 liter Simons electrochemical fluorination cell of the type described in U.S. Pat. No. 2,713,593, equipped with three overhead condensers having brine temperatures of 18° C., −40° C., and −80° C. respectively, was fitted with a one liter metal cylinder filled with a mixture of perfluorochemicals comprising primarily perfluoro(butyl-1-tetrahydrofuran) and having a boiling range of 90°–107° C. The cylinder was connected to a drain valve at the bottom of the cell. A centrifugal micropump was connected to the one liter cylinder and to an inlet fitting at the top of the cell, so that the perfluorochemicals could be circulated from the cell to the cylinder, and back to the cell, with the one liter cylinder serving as a reservoir of perfluorochemicals. The cell was charged with 2 kg of anhydrous hydrogen fluoride, an additional 280 ml of the above-described mixture of perfluorochemicals, and 300 g of hexafluoropropene. The micropump was started, and the cell was maintained at a voltage of 6.4 volts and an average temperature of 32° C. After about 2 hours, a maximum cell pressure of 50 psig (2585 torr gauge) was achieved and then decreased. The cell current was initially 26.5 A, but the current declined during the course of the run (as the hexafluoropropene was fluorinated) such that the average cell current was 9.8 A. The conversion of hexafluoropropene to perfluoropropane was monitored by gas chromatography. At about 95% conversion, the crude cell product resulting from the fluorination (comprising perfluoropropane and anhydrous hydrogen fluoride) was collected by warming the cell to 45°–50° C. and the product from the condenser maintained at −80° C. to a bottle chilled in a dry ice/acetone cold trap. A small amount of product was also collected from the bottom of the cell. The collected product was phase-separated from the hydrogen fluoride, and the hydrogen fluoride was returned to the cell.

At this point, the cell was charged with an additional 300 g of hexafluoropropene which was then fluorinated to 95% conversion at an average cell temperature of 31° C. and an average cell current of 9.3 A. The resulting crude cell product was collected as described above. The cell was then charged for a third time with 300 g of hexafluoropropene, which was fluorinated at an average cell temperature of 30° C. and an average cell current of 7.6 A. Analysis (GC) of the resulting crude cell product (corrected for its added perfluorochemical content) showed its composition to be 95 weight percent $C_3F_8$, 2 weight percent hexafluoropropene, 0.3 weight percent $C_3F_8O$, 0.3 weight percent $C_2F_6$, 0.6 weight percent $C_4F_{10}$, and 0.8 weight percent $C_6F_{14}$.

Comparative Example

Preparation of Perfluoropropane by Electrochemical Fluorination of Hexafluoropropene in the Absence of Higher Boiling Perfluorochemical Compounds The Simons electrochemical fluorination cell described above in Example 3 was charged with 2 kg of anhydrous hydrogen fluoride and 300 g of hexafluoropropene. The cell voltage was maintained at 6.0 volts. After about 2 hours, a maximum cell pressure of 50 psig (2585 torr gauge) was achieved and then decreased. Initially, the cell temperature was 26° C. and the cell current was 34 A, but both the temperature and the current decreased during the course of the run (as the hexafluoropropene was fluorinated) such that the average cell temperature was 17° C. and the average cell current was 10.6 A. Since the average temperature fell below the temperature of the first condenser, the first condenser was shut off. The conversion of hexafluoropropene to perfluoropropane was monitored by gas chromatography. At about 95% conversion, the crude cell product resulting from the fluorination was collected as described above in Example 3, and the cell was charged with another batch of about 300 g of hexafluoropropene. This second batch was fluorinated to 95% conversion at an average cell temperature of 9° C. and an average cell current of 2.5 A, and the resulting crude cell product was collected as described above. The cell was then sequentially charged with a third, a fourth, and a fifth batch of hexafluoropropene. The average cell temperature for the three batches was 16° C., and the average cell current of 6.9 A. The cell voltage was maintained at 6.4 volts. The resulting crude cell product was collected in each case as described above and was analyzed by GC, showing a composition of 85 weight percent $C_3F_8$, 3.6 weight percent hexafluoropropene, 0.6 weight percent $C_3F_8O$, 0.3 weight percent $C_2F_6$, 0.6 weight percent $C_4F_{10}$, and 6.5 weight percent $C_6F_4$.

A comparison of Example 3 and this Comparative Example shows that hexafluoropropene can be fluorinated at higher average cell temperatures and higher average currents when a separate, higher-boiling fluorochemical phase is maintained than in the absence of such a fluorochemical phase. Furthermore, in this Comparative Example, the low average cell temperature obviated the use of the first (water) condenser, placing all of the condensation heat load on the refrigerated condensers.

Example 4

Preparation of Perfluorobutane by Electrochemical Fluorination of Butane in the Presence of Perfluorohexane Generated in Situ A 2.5 liter Simons electrochemical fluorination cell of the type described in U.S. Pat. No. 2,713,593, equipped with two overhead condensers having brine temperatures of 22° C. and −40° C. respectively (and having the lower temperature condenser connected to a decanter so that condensate could be optionally either collected or returned to the cell), was charged with about 2 kg of anhydrous hydrogen fluoride. 25 g of dimethyl disulfide was added, and the cell was run at 50 A for one hour to confirm the conductivity of the cell. 375 g of butane and 320 g of perfluorobutane were then added to the cell, followed by a continuous feed of butane at an average rate of 9.28 g/50Ahr until the cell reached steady-state operation at 5.2 to 5.5 volts, 30 A, and 60 psig (3102 torr gauge). The butane feed was then discontinued, and a second feed constituting a mixture of 2 parts by weight hexane to 1 part by weight butane was fed to the cell at an average rate of 7.16 g/50Ahr. The steady-state temperature of the cell was about 40° C., the cell pressure was 60 psig (3102 torr gauge), and the cell voltage was 5.0 to 5.2 volts. After 2792 Ahrs, the fluorochemical phase resulting from the fluorination of the hexane/butane mixture was drained from the cell and from a decanter attached to the −40° C. condenser, and the cell voltage increased markedly to 7.0 volts. The drainings were cooled to −78° C. (dry ice-acetone), phase-separated, and the hydrocarbon-rich phase was removed. Analysis (GC) of a sample of the thus-treated cell drainings showed a composition of 34.9 weight percent $C_4F_{10}$, 0.7 weight percent $C_4H_{10}$, 52.6 weight percent $C_6F_{14}$, 1.6 weight percent $C_6H_4$, and 10.3 weight percent other compounds (primarily partially-fluorinated butane and hexane). Analysis (GC) of a sample of the thus-treated decanter drainings showed a composition of 77.8 weight percent $C_4F_{10}$, 1.1 weight percent $C_4H_{10}$, 13.4 weight percent $C_6F_{14}$, 1.8 weight percent $C_6H_{14}$, and 5.9 weight percent other compounds (primarily partially-fluorinated butane and hexane). The run was then continued for a total of 14447 Ahrs, charging the cell intermittently with anhydrous hydrogen fluoride to make up for losses, and intermittently draining only part of the fluorochemical phase so as to maintain the presence of a fluorochemical phase in the cell.

Various modifications and alterations of this invention will become apparent to those skilled in the art without departing from the scope and spirit of this invention.

We claim:

1. A process for preparing fluorochemical compounds, which comprises (a) forming a mixture comprising at least one fluorinatable, non-functional organic starting compound and at least one other compound, wherein said other compound is present in an amount to enable the formation of a separate liquid fluorochemical phase, and said other compound is selected from the group consisting of (i) perfluorochemical compounds which boil at a higher temperature than either said fluorinatable, non-functional organic starting compound or the fluorochemical compound resulting from the subsequent fluorination of said fluorinatable, non-functional organic starting compound; and (ii) precursor compounds which can be fluorinated in situ to produce said perfluorochemical compounds; and (b) subjecting said mixture to Simons electrochemical fluorination in anhydrous hydrogen fluoride.

2. The process of claim 1 wherein said fluorinatable, non-functional organic starting compound is selected from the group consisting of ethers, amines, amino ethers, aliphatic hydrocarbons, aliphatic halocarbons, aliphatic halohydrocarbons, cyclic hydrocarbons, cyclic halocarbons, cyclic halohydrocarbons, organic divalent sulfur compounds, and mixtures thereof.

3. The process of claim 2 wherein said fluorinatable, non-functional organic starting compound is selected from the group consisting of aliphatic hydrocarbons, aliphatic halohydrocarbons, cyclic hydrocarbons, cyclic halohydrocarbons, and mixtures thereof.

4. The process of claim 3 wherein said fluorinatable, non-functional organic starting compound boils below room temperature at atmospheric pressure.

5. The process of claim 2 wherein said fluorinatable, non-functional organic starting compound boils below room temperature at atmospheric pressure.

6. The process of claim 5 wherein said fluorinatable, non-functional organic starting compound is selected from the group consisting of propane, butane, and hexafluoropropene.

7. The process of claim 1 wherein said fluorinatable, non-functional organic starting compound boils below room temperature at atmospheric pressure.

8. The process of claim 7 carried out with continuous removal of said fluorochemical compound at the rate at which said fluorochemical compound is produced.

9. The process of claim 1 wherein each said other compound boils at a temperature which is at least about 20° C. higher than the boiling point of said fluorinatable, non-functional organic starting compound or the fluorochemical compound resulting from the subsequent fluorination of said fluorinatable, non-functional organic starting compound.

10. The process of claim 9 wherein said other compound boils at a temperature which is at least about 50° C. higher than the boiling point of said fluorinatable, non-functional organic starting compound or the fluorochemical compound resulting from the subsequent fluorination of said fluorinatable, non-functional organic starting compound.

11. The process of claim 1 wherein each said other compound is a perfluorochemical compound.

12. The process of claim 11 wherein said perfluorochemical compound is selected from the group consisting of perfluoroalkanes, pentafluorosulfanyl-substituted perfluoroalkanes, perfluorocycloalkanes, perfluoroamines, perfluoroethers, perfluoropolyethers, perfluoroaminoethers, perfluoroalkanesulfonyl fluorides, perfluorocarboxylic acid fluorides, and mixtures thereof.

13. The process of claim 12 wherein said perfluorochemical compound is a perfluoroalkane.

14. The process of claim 1 further comprising the step of recovering said fluorochemical compound.

15. The process of claim 1 carried out continuously.

16. A process for preparing perfluoropropane or perfluorobutane, which comprises (a) forming a mixture comprising an aliphatic hydrocarbon selected from the group consisting of propane and butane, and at least one wherein perfluoroalkane, said perfluoroalkane is present in an amount to enable the formation of a separate liquid fluorochemical phase, and said perfluoroalkane has a boiling point which is higher than that of either said aliphatic hydrocarbon or the perfluoroalkane resulting from the subsequent fluorination of said aliphatic hydrocarbon; and (b) subjecting said mixture to Simons electrochemical fluorination in anhydrous hydrogen fluoride.

* * * * *